US008764012B2

(12) United States Patent
Akihiro et al.

(10) Patent No.: US 8,764,012 B2
(45) Date of Patent: Jul. 1, 2014

(54) SHEET TRANSFER MECHANISM FOR PRINTER WITH SUCTION THROUGH-HOLE DENSITY ADJUSTER

(75) Inventors: Naoki Akihiro, Amimachi (JP); Tomohiko Shimoda, Amimachi (JP); Hiroshi Sugitani, Amimachi (JP)

(73) Assignee: Riso Kagaku Corporation, Minato-Ku, Tokyo (JP)

( * ) Notice: Subject to any disclaimer, the term of this patent is extended or adjusted under 35 U.S.C. 154(b) by 425 days.

(21) Appl. No.: 12/588,036

(22) Filed: Oct. 1, 2009

(65) Prior Publication Data

US 2010/0084803 A1 Apr. 8, 2010

(30) Foreign Application Priority Data

Oct. 3, 2008 (JP) ..... P2008-259074
Oct. 3, 2008 (JP) ..... P2008-259087

(51) Int. Cl.
*B65H 5/04* (2006.01)
*B41J 11/00* (2006.01)
*B65H 5/22* (2006.01)

(52) U.S. Cl.
CPC ..... *B41J 11/007* (2013.01); *B65H 5/224* (2013.01)
USPC ..... 271/276

(58) Field of Classification Search
USPC ..... 271/3.22, 276, 197
See application file for complete search history.

(56) References Cited

U.S. PATENT DOCUMENTS 6,543,948 B2 * 4/2003 Beehler et al. ..... 271/276
2009/0039595 A1 * 2/2009 Yoda et al. ..... 271/276

FOREIGN PATENT DOCUMENTS

| | | | | |
|---|---|---|---|---|
| JP | 5-56376 | A | | 7/1993 |
| JP | 2007-133035 | | | 5/1995 |
| JP | 07-281495 | A | | 10/1995 |
| JP | 07281495 | A | * | 10/1995 |
| JP | 2005-170547 | A | | 6/2005 |
| JP | 2006-206309 | A | | 8/2006 |
| JP | 2007-015138 | A | | 1/2007 |
| JP | 2007015138 | A | * | 1/2007 |
| JP | 2007-031007 | | | 2/2007 |
| JP | 2007031007 | A | * | 2/2007 |
| JP | 2007-302406 | A | | 11/2007 |
| JP | 2009-234017 | A | | 10/2009 |

* cited by examiner

*Primary Examiner* — Gerald McClain
(74) *Attorney, Agent, or Firm* — Nath Goldberg & Meyer; Jerald L. Meyer

(57) ABSTRACT

A sheet transfer mechanism for a printer (100) to form an image on a sheet (10) being transferred in a transfer route by propelling ink at ink heads (110*a*), includes: a transfer belt (160) that has a plurality of adhesion through-holes (165) for holding a sheet (10) and transfers the sheet (10) being held thereon, a platen (620) that slidably supports the transfer belt (160) in an area facing the ink heads (110*a*) and has a plurality of suction through-holes (622) in an area through which the plurality of the adhesion through-holes (165) pass; a suction fan (650) that generates airflow with negative pressure for holding the sheet (10) on the transfer belt (160) through the plurality of the suction through-holes (622) and the plurality of the adhesion through-holes (165); and plugging plates (624) that adjust a number density of the suction through-holes (622) in the platen (620) depending on an arrangement of the ink heads (110*a*).

10 Claims, 15 Drawing Sheets

FIG. 10A
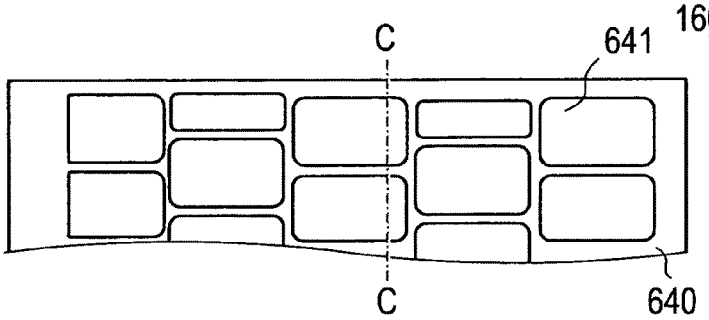
FIG. 10B
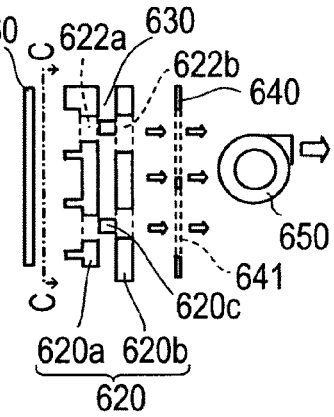
FIG. 11A
FIG. 11B
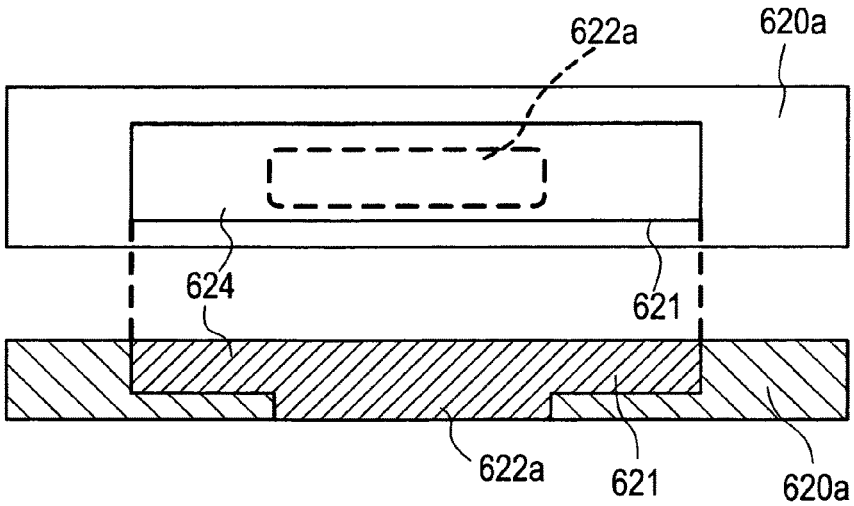

FIG. 12A
FIG. 12B
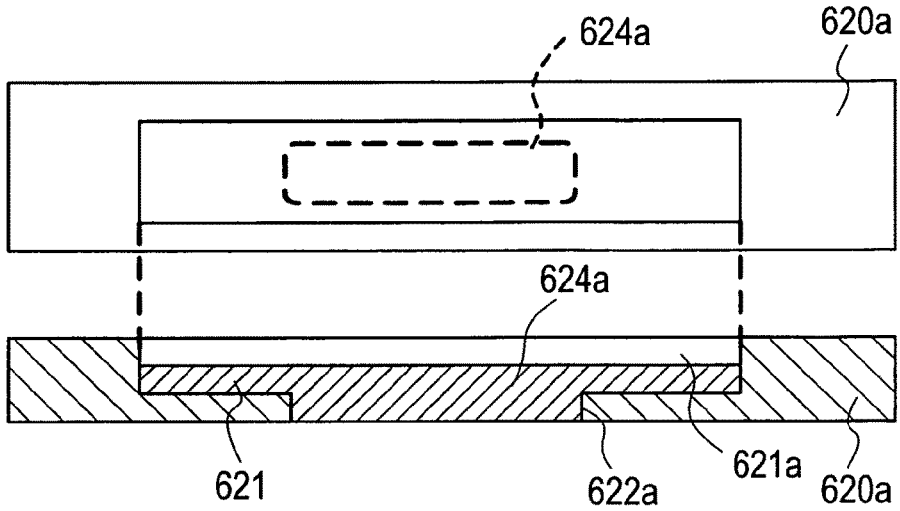
FIG. 13A
FIG. 13B
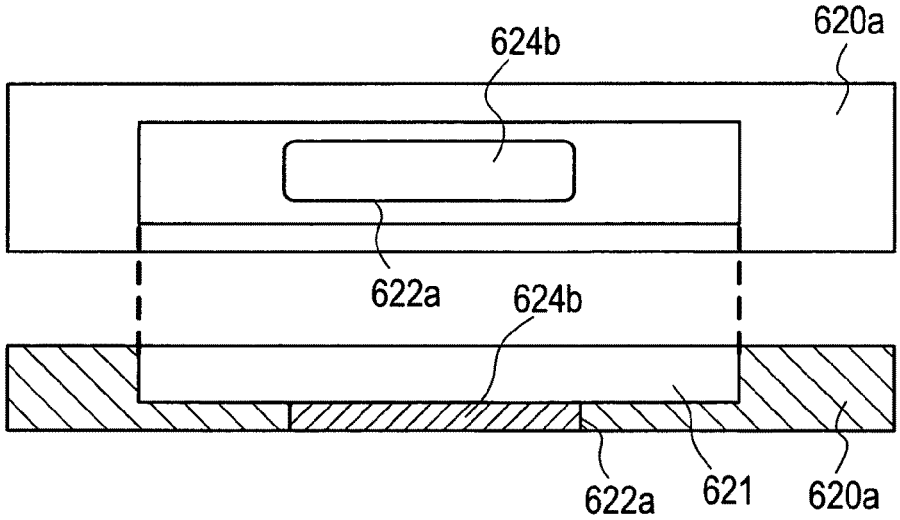

FIG. 18A
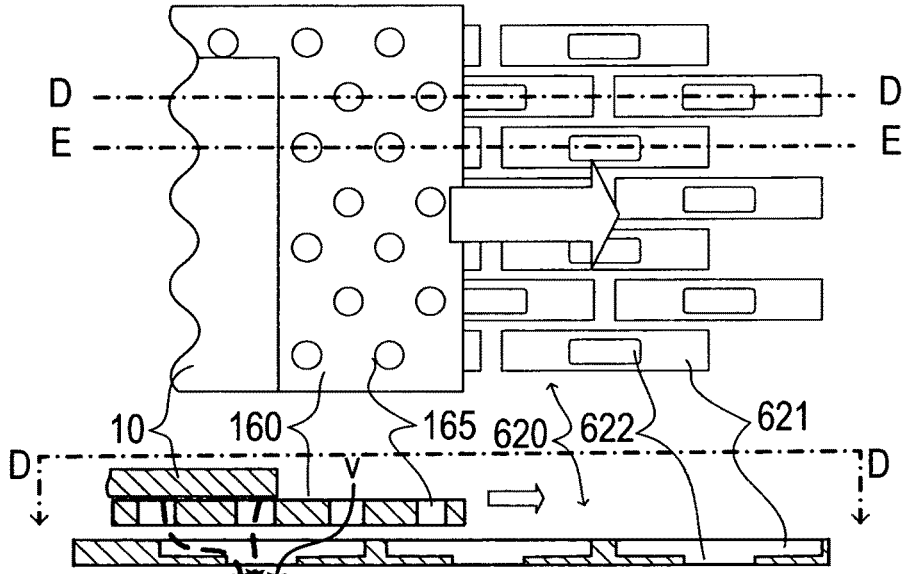
FIG. 18B
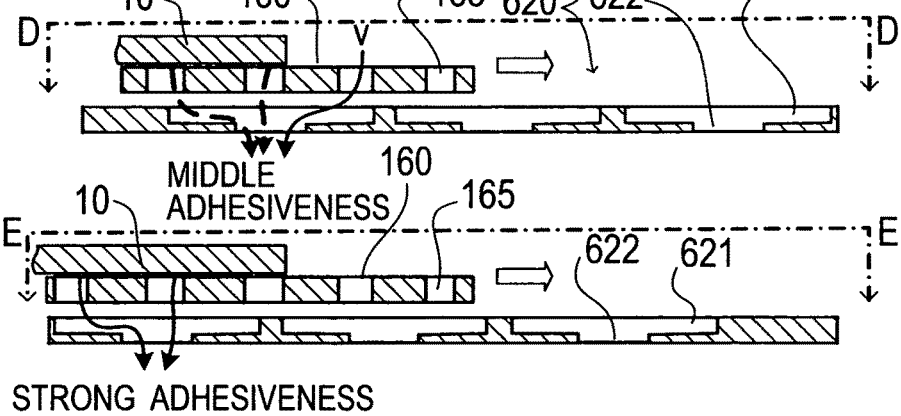
FIG. 18C
STRONG ADHESIVENESS

SHEET TRANSFER MECHANISM FOR PRINTER WITH SUCTION THROUGH-HOLE DENSITY ADJUSTER

BACKGROUND OF THE INVENTION

1. Field of the Invention

The present invention relates to a sheet transfer mechanism for a printer to form an image on a sheet being transferred in a transfer route by propelling ink at an image former.

2. Description of Related Arts

When an inkjet type printer forms an image by propelling ink droplets on a sheet, it is necessary to keep a certain space between a surface of the sheet and ink heads in order to avoid influences of wrinkles and a wavelike deformation (hereinafter referred to as cockling) as much as possible, so that stable printing is performed. In addition, when a sheet gets swelling due to water-based ink or moisture, it is necessary to prevent the sheet on a transfer belt from being lifted toward the print head.

Therefore, such an inkjet type printer requires a method for tightly attaching a sheet to a transfer mechanism. To do so, it has been well known a printer capable of transferring a sheet and attaching the sheet to the transfer mechanism evenly and strongly.

However, it is actually difficult to transfer a sheet keeping in an even condition, while attaching and pressing the sheet to the transfer mechanism. The more a printer is required to prevent a sheet from cockling widely, the more cockling is caused locally. As a result, local cockling portions of the sheet may come into contact with ink heads.

Meanwhile, Patent Document 1 (Japanese Patent Laid-Open Publication No. H07-133035) discloses a sheet transfer mechanism with an electrostatic adherence system capable of keeping an uplift of cockling portions of a sheet under a certain height by tightly attaching the sheet to the sheet transfer mechanism by use of a comb-type electrode, which prevents the cockling portions from influencing printing performance.

In addition, Patent Document 2 (Japanese Patent Laid-Open Publication No. 2007-031007) discloses a sheet transfer mechanism with an air suction system. The sheet transfer mechanism has two or more rollers provided with given intervals for driving a circular belt, formed with through-holes, having a larger width than a transfer sheet in a direction perpendicular to a sheet transfer direction. The sheet transfer mechanism suctions air from through-holes provided on the belt in order to bring the through-holes under negative pressure with respect to atmospheric pressure.

SUMMARY OF THE INVENTION

However, the method of Patent Document 1 cannot deal with cockling by use of the air suction system since Patent Document 1 only employs the electrostatic adherence system. Moreover, the electrostatic adherence system requires a high voltage generating means for the operation. Therefore, it is necessary to prepare a large-scale device for the electrostatic adherence system, which results in an increase in production costs.

In general, in order to achieve high quality images in an image forming process, it is necessary to keep a sheet in flat condition especially under ink heads. The method of Patent Document 1, however, may cause swelling on some areas in a sheet, which may be placed under ink heads.

According to the sheet transfer mechanism with the air suction system described in Patent Document 2, a suction effect acting on a sheet by a fan is available only when suction through-holes in the sheet transfer belt and suction through-holes in a plate for supporting the sheet transfer belt (hereinafter referred to as a platen) overlap each other. Thus, the method of Patent Document 2 causes local suction gaps and pulsation of suction airflow. This prevents a desirable suction effect from being achieved stably.

Moreover, a large amount of airflow is required to obtain necessary suction force since the suction effect is available only when the respective suction through-holes in the platen and the transfer belt overlap each other. Such strong airflow causes a spread of blot due to ink mist.

The present invention has been made to solve the above-mentioned problem. It is a main object of the present invention to provide a sheet transfer mechanism for a printer capable of preventing a sheet from cockling and being lifted by use of a simple configuration, and capable of holding swelling portions of a sheet by suctioning at appropriate locations so as to easily maintain flatness of the sheet under ink heads, by controlling suction force depending on shapes of suction openings.

It is a subsidiary object of the present invention to provide a sheet transfer mechanism for a printer capable of preventing blot caused by ink mist and stabilizing suction force acting on a sheet by controlling pulsation of suction airflow, and capable of improving an suction effect by the dispersion of suction force in order to reduce power consumption and noise.

To achieve the above-mentioned object, according to an aspect of the present invention, a sheet transfer mechanism of a printer comprises: a transfer belt that has a plurality of adhesion through-holes for holding a sheet and transfers the sheet being held thereon; a platen that slidably supports the transfer belt in an area facing the image former and has a plurality of suction through-holes in an area through which the plurality of the adhesion through-holes pass; an aspirator that generates airflow with negative pressure for holding the sheet on the transfer belt through the plurality of the suction through-holes and the plurality of the adhesion through-holes; and an adjuster that adjusts a number density of suction through-holes in the platen depending on an arrangement of the image former.

BRIEF DESCRIPTION OF DRAWINGS

FIG. 10A is an upper surface view of an airflow equalizing plate 640 provided under a lower plate according to the present embodiment FIG. 10B is a cross-sectional view taken along the line C-C in FIG. 10A.

FIG. 11A is an upper surface view of a concave portion, a suction through-hole and a plugging plate of a platen according to the present embodiment. FIG. 11B is a cross-sectional view of the concave portion, the suction through-hole and the plugging plate of the platen.

FIG. 12A is an upper surface view of a concave portion, a suction through-hole and a plugging plate of a platen according to a modified example. FIG. 12B is a cross-sectional view of the concave portion, the suction through-hole and the plugging plate of the platen according to the modified example.

FIG. 13A is an upper surface view of a concave portion, a suction hope and a plugging plate of a platen according to another modified example. FIG. 13B is a cross-sectional view of the concave portion, the suction through-hole and the plugging plate of the platen according to the modified example.

FIG. 18A is a view showing a shift in suction force due to a sheet movement on a transfer belt according to the present embodiment FIG. 18B is a cross-sectional view taken along the line D-D in FIG. 18A. FIG. 18C is a cross-sectional view taken along the line E-E in FIG. 18A.

DETAILED DESCRIPTION OF AN EMBODIMENT

We now describe an embodiment of the present invention with reference to the drawings.

(Overall Configuration of Printer)

Figure 1A:
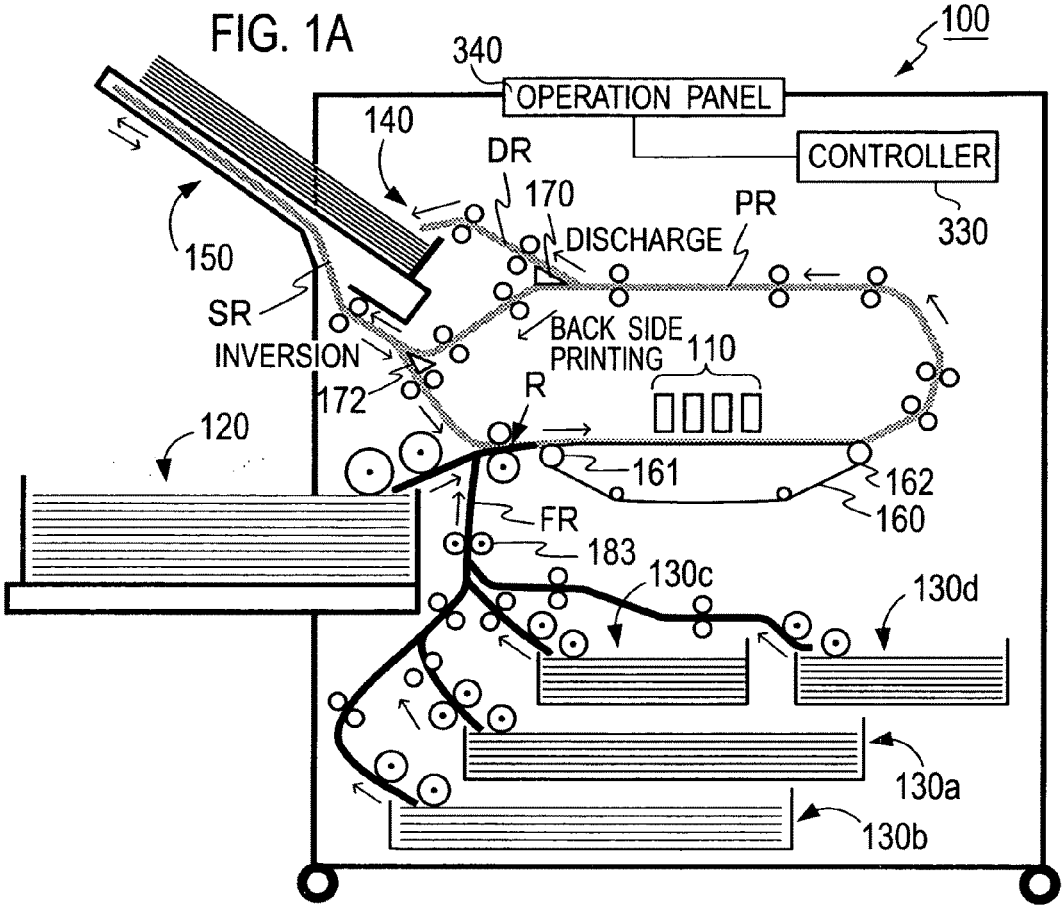
FIG. 1A is a schematic view showing a sheet transfer route of a printer according to an embodiment of the present invention.

FIG. 1A is a schematic view showing a sheet transfer route of a printer 100 according to the embodiment. The printer 100 is a line color printer of an inkjet type that includes a plurality of ink heads provided with multiple nozzles. The printer 100 performs printing by lines with black or color ink propelled from each ink head, so as to form an image by overlapping a plurality of frames on a sheet on a transfer belt.

As shown in FIG. 1, the printer 100 is generally composed of a system of feed routes FR for feeding a sheet, a discharge route DR for discharging the sheet, a normal transfer route PR for transferring the sheet received from the system of feeding routes FR to the discharging route DR via a head unit 110, and an inverting route SR branched from the normal transfer route PR, for inverting the sheet between front and back sides received from the normal transfer route PR to re-feed to the normal transfer route PR. The inverting route SR cooperates with the normal transfer route PR to constitute a looped sheet circulating transfer route CR.

The printer 100 has sheet feeding mechanisms in the system of feed route FR for feeding a sheet one by one including a side feed table 120 provided at an outside of a side surface of a casing, and a plurality of feed trays 130*a*, 130*b*, 130*c* and 130*d* (hereinafter collectively referred to as "130") provided in the casing. Also, the printer 100 has a sheet discharge mechanism including a discharge port 140 for discharging printed sheets.

A sheet is fed one by one from the side feed table 120 or any feed tray 130 of the sheet feeding mechanisms, and transferred along one route of the system of feed routes FR by drive mechanisms such as rollers. Then, the sheet is guided to a register R for positioning a front edge of the fed sheet. The sheet is further transferred to the head unit 110, which is provided with a plurality of print heads downstream of the register R in a sheet transfer direction, by a transfer belt 160 facing an ink-droplet-propelling side of the head unit 110 at a predetermined transfer speed depending on printing conditions. The sheet transferred to the head unit 110 is to have an image formed by ink propelled from the respective print heads by lines.

The printed sheet is further transferred in the normal transfer route PR by the drive mechanisms such as rollers. For one-side printing, the sheet is guided to the discharge port 140 so as to be discharged to stack with a printed side down on a discharge table 150 provided as a print sheet receiver of the discharge port 140. The discharge table 150 is formed in a shape of a tray protruding from the casing with a certain thickness. The discharge table 150 is inclined to a lateral wall of the casing. Thus, the sheet discharged from the discharge port 140 is slid down along an inclination of the discharge table 150, and piled up on the discharge table 150.

For both-side printing, assuming "a front side" as the side to be printed first and "a back side" as the side to be printed next, a sheet printed on the front side is further transferred in the casing without being guided to the discharge route DR. The sheet not guided to the discharge route DR is thus transferred to the inverting route SR by a route select mechanism 170 provided to switch a sheet transfer route from the discharge mute DR to the inverting route SR for back side printing.

The sheet in the inverting route SR received from the normal transfer route PR is inverted between the front side and the back side by making the sheet reciprocate in the inverting route SR, which is a so-called switchback. Then, the sheet is re-fed to the normal transfer route PR via the route select mechanism 172, and transferred through the register R to have an image on the back side formed in a similar manner to the front side. After back-side printing, sheet with images on both sides is guided to the discharge port 140 via the discharge route DR so as to be discharged and piled on the discharge table 150.

According to the present embodiment, an internal space of the discharge table 150 is used to perform a switchback for both-side printing. The space in the discharge table 150 is enclosed to keep sheets from being taken from outside during the switchback. Thus, it is possible to prevent the sheets from being pulled out by a user during the switchback. In addition, it is possible to eliminate an extra space for the switchback in the printer 100 due to the internal space of the discharge table 150, which is an inherent member to the printer 100. This prevents the casing from being enlarged in size. The inverting route SR that is separated from the discharge route DR allows for parallel operations between a sheet to be switched back and another sheet to be discharged.

In the printer 100, the register R for positioning a front edge of a sheet fed from the system of feed mutes FR also receives a sheet having an image on the front side to be re-fed for both-side printing. Thus, there is a junction provided upstream of the register R in the sheet transfer direction, where the system of feed routes FR for newly feeding a sheet meets the normal transfer route PR for circulating a sheet having an image on the front side. The register R receives and transfers a sheet adjacent to the junction of the system of feed routes FR and the inverting route SR in the normal transfer route PR.

Figure 1B:
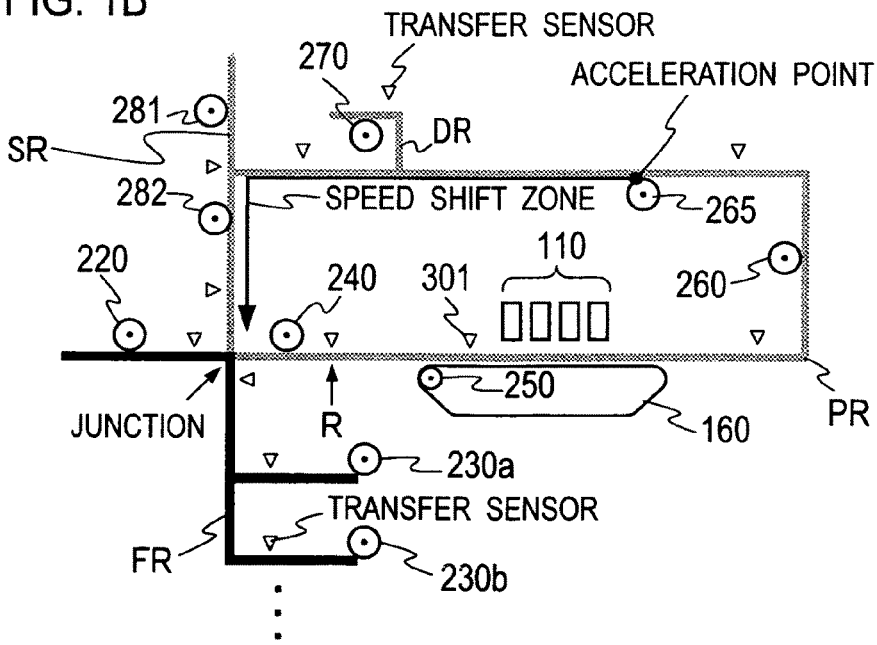
FIG. 1B is a block diagram showing a system of feed routes FR, a sheet discharge route DR, a normal transfer route PR and an inverting route SR.

FIG. 1B is a block diagram showing the system of feed routes FR, the discharge route DR, the normal transfer route PR and the inverting route SR. Note that, only main rollers composing the drive mechanisms are illustrated in the figure.

The system of feed routes FR includes a side feed drive mechanism 220 for feeding a sheet from the side feed table 120, and a set of tray drive mechanisms 230*a*, 230*b*, . . . (hereinafter collectively referred to as "230") for feeding a sheet from selected one of the feed trays 130. These drive mechanisms constitute a sheet feed means for feeding a sheet to the register R.

Each drive mechanism in the system of feed routes FR as mentioned above is composed of a plurality of rollers. The rollers are each operable to feed a sheet one by one from a stack of sheets in the side feed table 120 or any feed tray 130 to transfer to the register R. Each roller is independently controllable depending on feeding conditions of the sheet feeding mechanisms to feed a sheet.

The system of feed mutes FR is provided with a plurality of transfer sensors for detecting transfer jams therein. Each transfer sensor detects a presence or absence of a sheet, or a front edge of a sheet. These transfer sensors are provided at certain intervals in the system of feed routes FR. In this case, a transfer jam can be expected when any transfer sensor provided upstream in the sheet transfer direction detects a feeding sheet, and any transfer sensor provided downstream in the sheet transfer direction does not detect the sheet within a predetermined time.

A register sensor, one of the transfer sensors, provided upstream of the register R measures a size of a sheet based on a passing speed and passage time, for instance. In addition, when the register sensor does not detect a feeding sheet within a predetermined time after an operation of any drive mechanism of the side feed drive mechanism 220 and the tray drive mechanisms 230, a transfer jam (feeding error) can be expected.

The normal transfer route PR includes a register drive mechanism 240 for guiding a sheet to the register R, a transfer belt drive mechanism 250 for circularly activating the transfer belt 160 facing the head unit 110, a first upper transfer drive mechanism 260 and a second upper transfer drive mechanism 265 provided in order in the sheet transfer direction, an upper discharge drive mechanism 270 for guiding a printed sheet to the discharge port 140, and a drive mechanism for introducing a sheet having an image on the front side to the inverting route SR for back-side printing. Every drive mechanism is composed of one or a plurality of rollers, which transfer a sheet one by one along the sheet transfer route. Each roller is independently controllable depending on sheet transferring conditions.

The normal transfer route PR is also provided with a plurality of transfer sensors for detecting transfer jams therein. In addition, the register R is configured to be able to confirm whether a sheet is transferred properly. The transfer sensors in the normal transfer route PR detect transfer jams in the drive mechanisms. Thus, the transfer sensors can specify which drive mechanism is jammed in the normal transfer route PR.

The inverting route SR includes an inverting drive mechanism 281 for inverting a sheet to guide to the above-mentioned junction. In addition, a sheet can be transferred in the inverting route SR at a different speed from the normal transfer route PR. Thus, it is possible to increase and decrease speed when the inverting route SR receives a sheet from the normal transfer route PR, or prolong and shorten the time to make a sheet pause during a switchback.

According to the present embodiment, the printer 100 can feed a sheet not only after a previous sheet is printed and discharged, but also before the previous sheet is discharged so as to perform printing consecutively at certain intervals by scheduling. Therefore, regular scheduling in both-side printing is configured to preliminarily keep specified intervals in order to reserve space to insert a sheet returned from the inverting route SR when newly feeding a sheet. This permits the printer 100 to perform front-side printing and back-side printing in parallel, which achieves a print productivity in half the time it takes in one-side printing.

The transfer belt 160 is hitched to a drive roller 161 and a driven roller 162 provided upstream and downstream in the sheet transfer direction at both end portions of the transfer belt 160 facing an ink-droplet-propelling side of the head unit 110. The transfer belt 160 circularly runs on the both rollers in a clockwise direction in FIG. 1B. The head unit 110 includes an array of the four-color ink heads along the sheet transfer direction facing the upper side of the transfer belt 160. The head unit 110 forms an image in color by overlapping a plurality of frames by propelling ink from the ink heads.

As shown in FIG. 1, the printer 100 includes a controller 330. The controller 330 is a processing module that is composed of hardware such as a processor including CPU and DSP (Digital Signal Processor), memory and other electronic circuits, software such as a program including the above-mentioned functions, or a combination of those. The controller 330 virtually assembles a variety of functional modules by appropriately reading and executing programs, and executes image data processing, control processing of each component performance, and a variety of processing for user operations. In addition, the controller 330 is connected to an operation panel 340 to accept user commands and setting operations via the operation panel 340.

(Transfer Mechanism in Image Forming Route)

Figure 2:
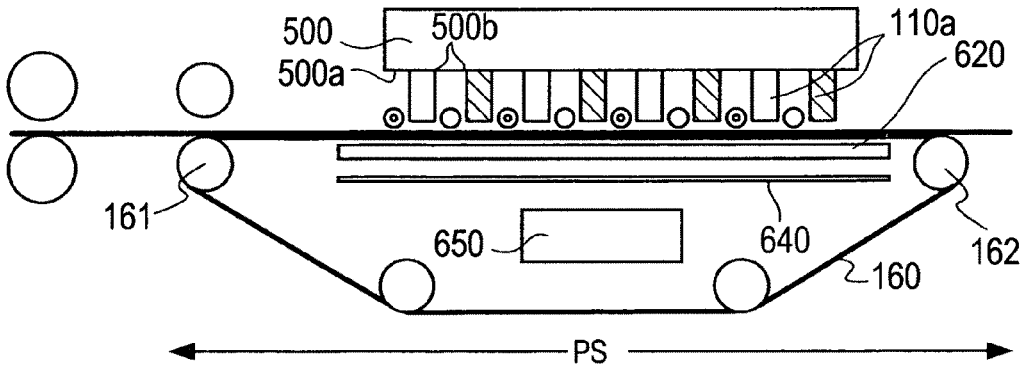
FIG. 2 is a side view showing an image forming section PS in a normal transfer route PR where images are formed according to the present embodiment.
Figure 3A:
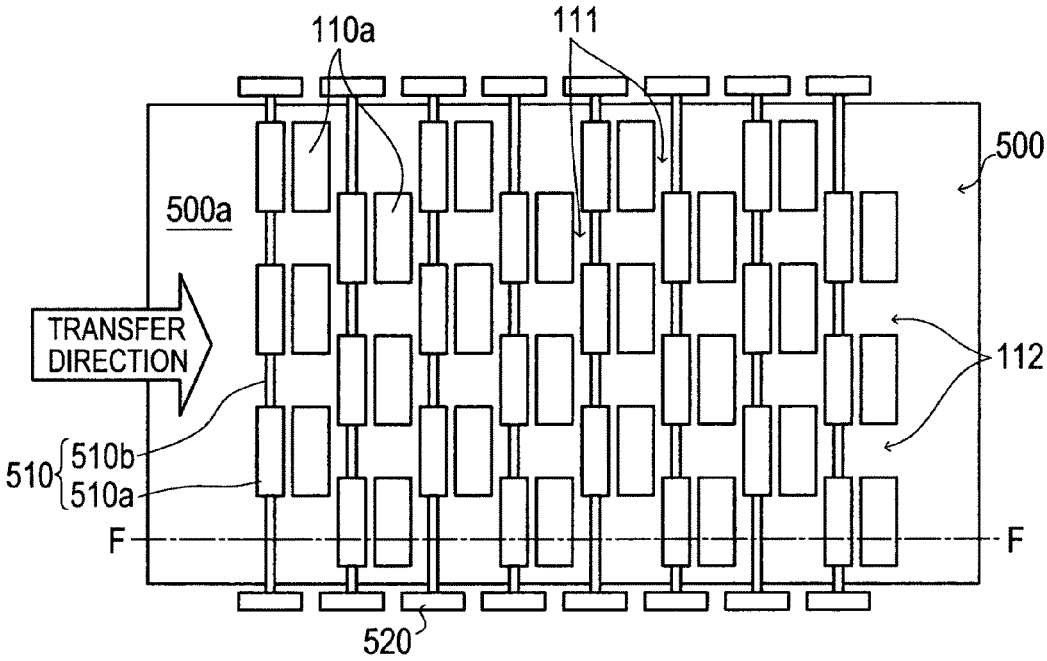
FIG. 3A is a view showing from under a head holder provided above an image forming section PS.
Figure 3B:
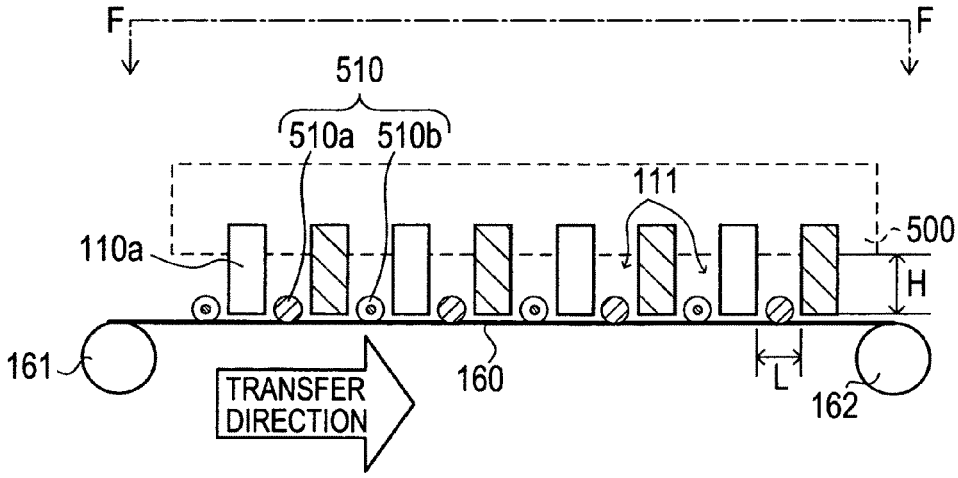
FIG. 3B is a cross-sectional view taken along the line F-F of the head holder in FIG. 3A.
Figure 4:
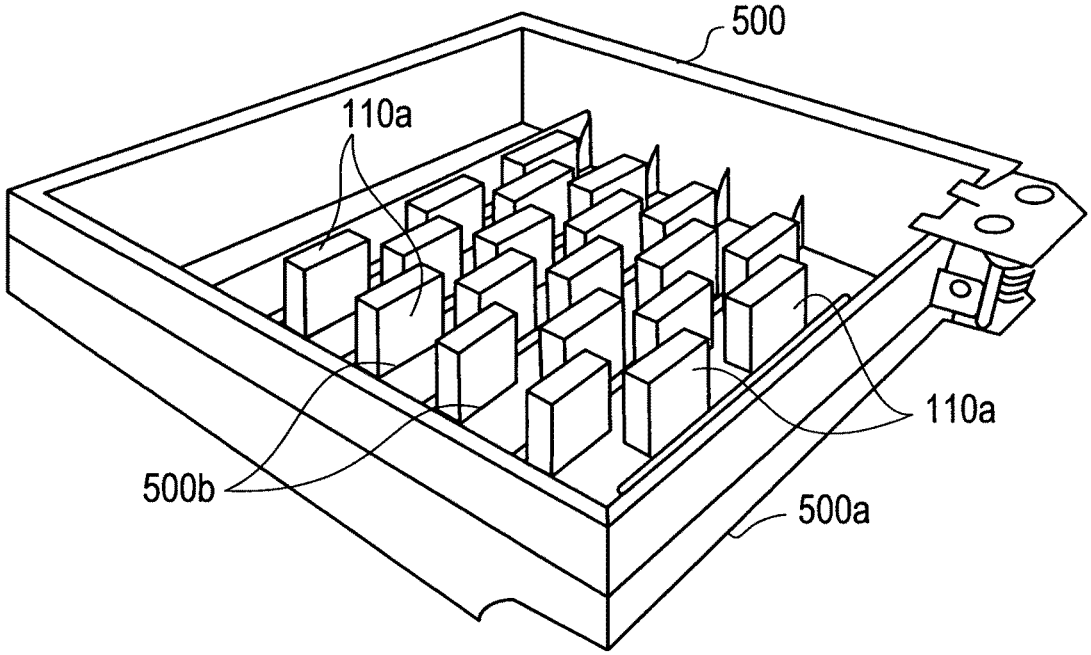
FIG. 4 is a perspective view showing from the top of a head holder according to the present embodiment.

FIG. 2 is a side view showing an image forming section PS in the normal transfer route PR where images are formed. FIG. 3A is a view showing from under a head holder 500 provided above the image forming section PS. FIG. 3B is a cross-sectional view taken along the line F-F of the head holder 500 in FIG. 3A. FIG. 4 is a perspective view showing from the top of the head holder 500.

The normal transfer route PR includes the image forming section PS composed of the transfer belt 160, the drive roller 161, the driven roller 162, and the like. The head holder 500 is provided above the image forming section PS. The head holder 500 is formed in a box shape including a head holder surface 500*a* that is a base surface of the head holder 500. The head holder surface 500*a* holds a plurality of ink heads 110*a* fixed thereon, and stores other functions for propelling ink from the ink heads 110*a* as a unit.

The head holder surface 500*a* is provided facing and parallel to the image forming section PS in the normal transfer route PR. The head holder surface 500*a* is provided with a plurality of insertion openings 500*b* that have the same shape as a horizontal cross section of each ink head 110*a* constituting the head unit 110. The ink heads 110*a* are inserted into the insertion openings 500*b* so that ink outlet portions of the respective ink heads 110*a* protrude from the head holder surface 500*a*.

The plurality of the ink heads 110*a* are arranged in several rows in a direction (main scanning direction) perpendicular to the sheet transfer direction (vertical scanning direction). The ink heads 110*a* are aligned in a zigzag manner in the holder surface 500*a* so that each ink head 110*a* in each row does not overlap with ink heads 110*a* in adjacent rows in the sheet transfer direction. The respective rows of the ink heads 110*a* are arranged at set intervals in the sheet transfer direction, and provided with main flow paths 111 therebetween. The ink heads 110*a* arranged at set intervals in each row are provided with vertical flow paths 112 therebetween. The main flow paths 111 and the vertical flow paths 112 are configured to form net-like ink mist purge paths by intersecting one another. According to the present embodiment, a protrusion height H of each ink head 110*a* from the head holder surface 500*a* is larger than a length L of each main flow path, as shown in FIG. 3B.

Each main flow path 111 is provided with stepped guide rollers 510. Each stepped guide roller 510 is configured to be a single roller composed of several guide rollers having different diameters and being connected each other. Each guide roller is made by shaping metal rods, for instance. Specifically, each of the stepped guide rollers 510 is composed of upstream guide rollers 510*a* with a larger diameter and downstream guide rollers 510*b* with a smaller diameter than the upstream guide rollers 510*a*, in which the upstream guide rollers 510*a* and the downstream guide rollers 510*b* are alternately arranged on a same rotating shaft. The upstream guide rollers 510*a*, which are provided upstream of each ink head 110*a* in the sheet transfer direction, rotate being biased downwardly and pressed on an upper surface of the image forming section PS. While, the downstream guide rollers 510*b*, which are provided downstream of each ink head 110*a* in the sheet transfer direction, are rotatably supported on the rotating shaft while being separated by a certain distance from the upper surface of the image forming section PS.

The upstream guide rollers 510*a* and the downstream guide rollers 510*b* are also aligned in a zigzag manner so as to correspond to the zigzag alignment of the ink heads 110*a*. The stepped guide rollers 510 are provided in the main flow paths 111 as described above. Thus, the upstream guide rollers 510*a* and the downstream guide rollers 510*b* are to be provided in the main flow paths 111 alternatively. According to the present embodiment, the stepped guide rollers 510 are rotatably supported on the rotating shafts that have respective shaft receivers 520 provided on both sides of the head holder surface 500*a* so as to be structurally-integrated with the head holder 500.

Figure 5:
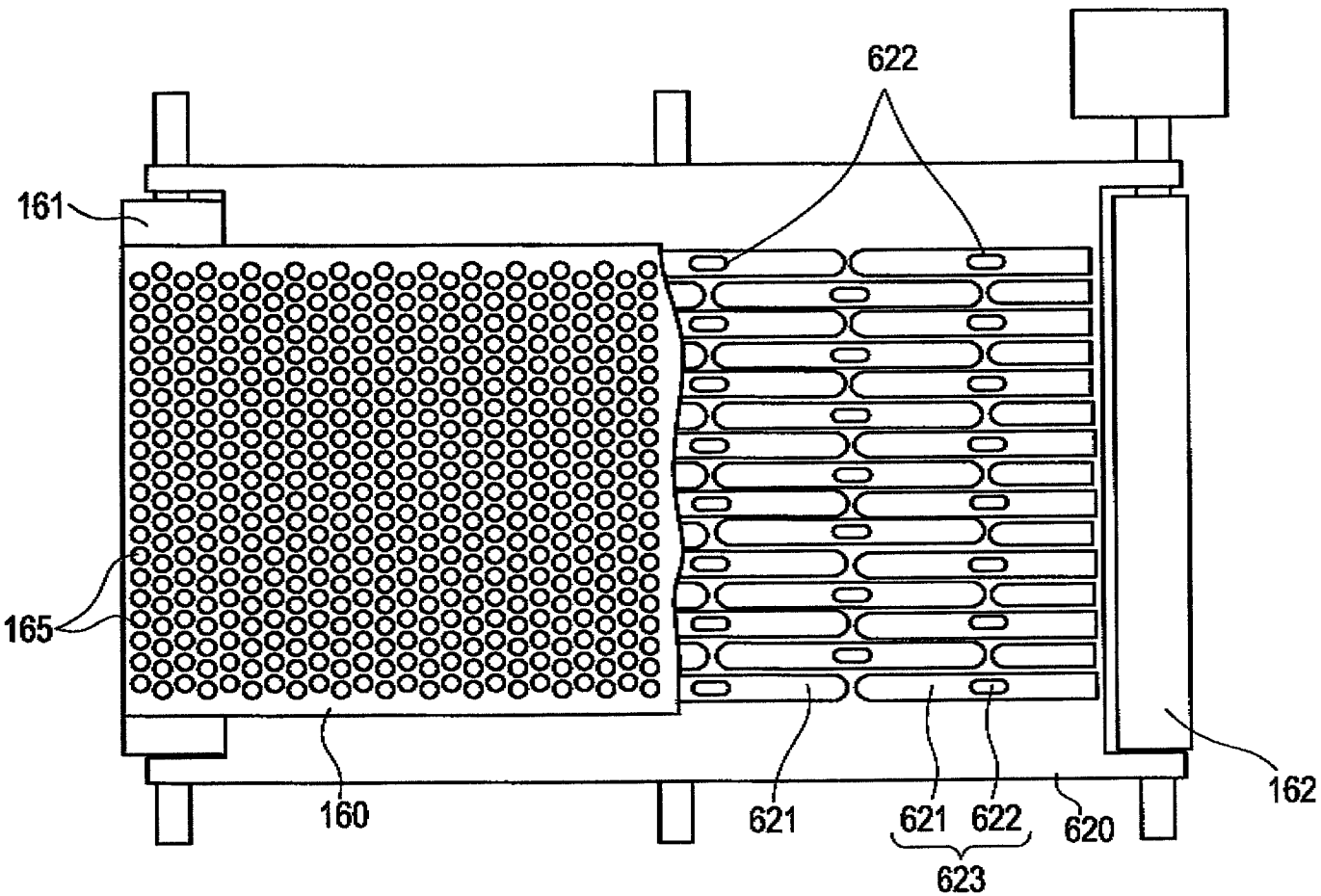
FIG. 5 is a partially cutaway view of a sheet transfer mechanism in an image forming section PS according to the present embodiment.
Figure 6:
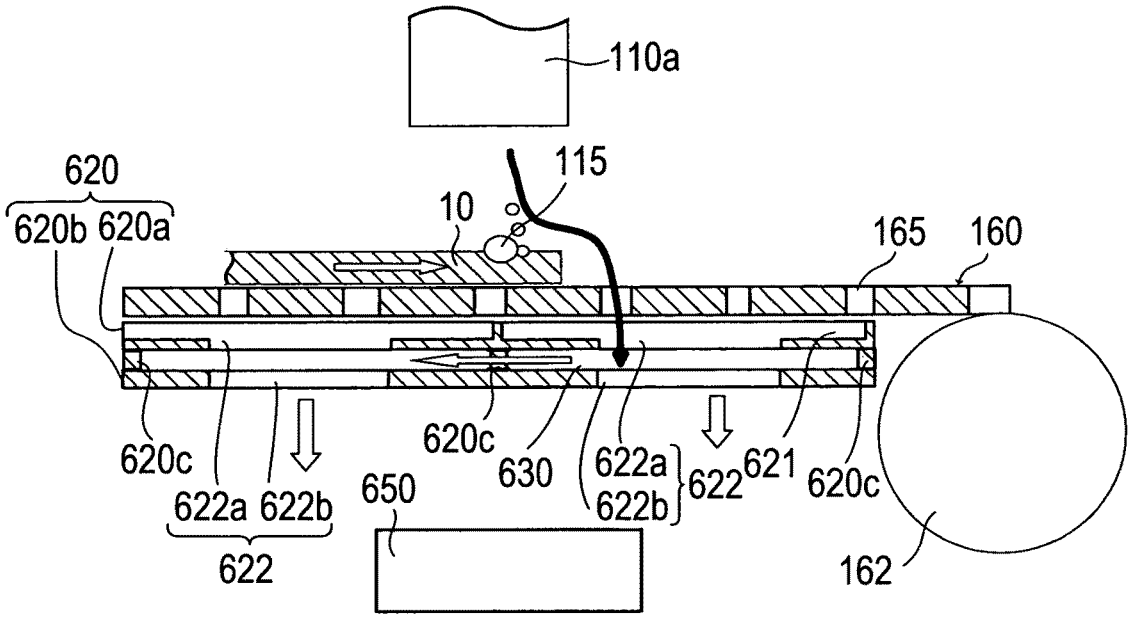
FIG. 6 is a side cross-sectional view showing a purge mechanism for ink mist according to the present embodiment.
Figure 7:
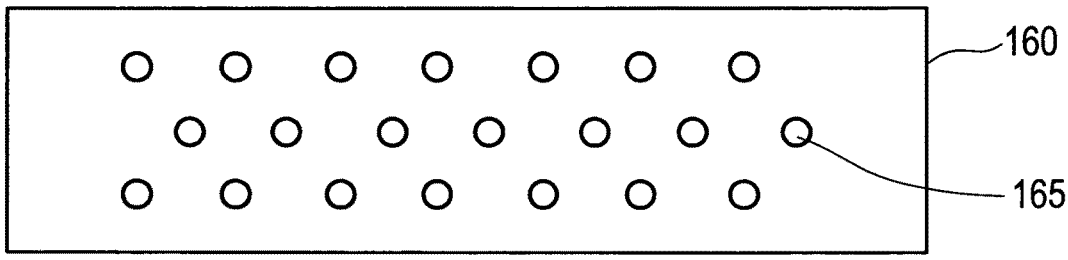
FIG. 7 is an upper surface view of a transfer belt according to the present embodiment.
Figure 8A:
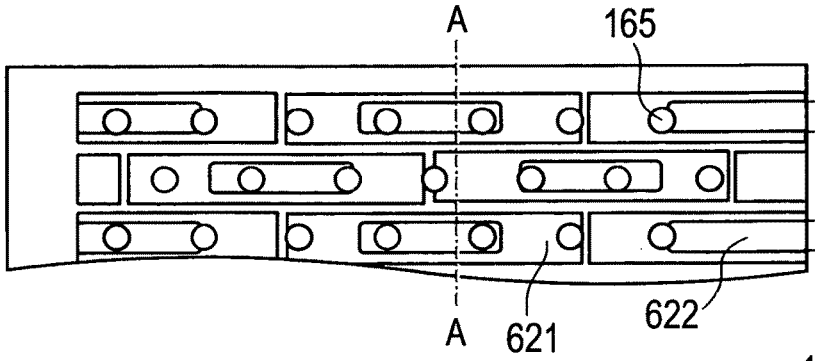
FIG. 8A is an upper surface view of an upper plate according to the present embodiment
Figure 8B:
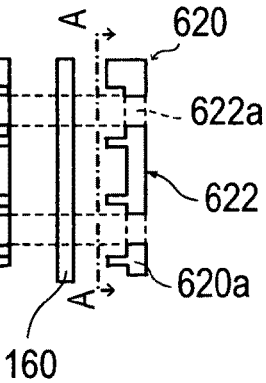
FIG. 8B is a cross-sectional view taken along the line A-A in FIG. 8A.

Next, we describe the sheet transfer mechanism in the image forming section PS. FIG. 5 is a partially cutaway view of the sheet transfer mechanism in the image forming section PS according to the present embodiment. FIG. 6 is a side cross-sectional view showing a purge mechanism for ink mist according to the present embodiment. FIG. 7 is an upper surface view of the transfer belt 160. FIG. 8A is an upper surface view of an upper plate 620*a*, and FIG. 8B is a cross-sectional view taken along the line A-A in FIG. 8A.

As shown in FIG. 5 and FIG. 6, the image forming section PS includes the transfer belt 160 for transferring a sheet 10, a platen 620 for supporting the transfer belt 160, an airflow equalizing plate 640 provided under the platen 620 for equalizing suction pressure, and a suction fan 650 provided under the airflow equalizing plate 640 for generating airflow with negative pressure.

As shown in FIG. 6 and FIG. 7, the transfer belt 160 has a plurality of adhesion through-holes 165 for holding the sheet 10 thereon. The transfer belt 160 is a looped belt for transferring the sheet 10 by sliding with the sheet 10 in an area facing an image former (ink heads 110*a*). The transfer belt 160 is supported by the platen 620 and hitched to the drive roller 161 and the driven roller 162 provided to be perpendicular to the sheet transfer direction. The transfer belt 160 circularly runs on the rollers in the sheet transfer direction and slides on an upper surface of the platen 620.

The platen 620 slidably supports the transfer belt 160 in the area facing the ink heads 110*a*. The platen 620 is a plate-like member having a plurality of suction through-holes 622 provided in an area through which the plurality of the adhesion holes 165 of the transfer belt 160 pass. The suction fan 650 provided under the platen 620 functions as an aspirator for generating airflow with negative pressure through the suction through-holes 622 and the adhesion through-holes 165 so as to hold a sheet on the transfer belt 160.

The platen 620 also has a plurality of concave portions 621 formed with given intervals therein being widely opened toward the surface (upper side) of the platen 620 and communicated with the suction through-holes 622. Note that, the suction through-holes 622 and the concave portions 621 formed in the platen 620 are collectively referred to as openings 623. In the present embodiment, concave portions 621 are aligned in a zigzag manner so that the respective side spaces do not overlap in a direction perpendicular to the sheet transfer direction. While the zigzag alignment is employed for the concave portions 621 in the present embodiment, areas or positions of the concave portions 621 can be varied alternately, for instance.

The suction fan 650 functions as an aspirator for generating airflow with negative pressure through the suction through-holes 622 and the adhesion through-holes 165 so as to hold a sheet on the transfer belt 160. As shown in FIG. 6, ink mist generated from the ink head 110*a* is eliminated downwardly through the adhesion through-holes 165 in the transfer belt 160 and the suction through-holes 622 in the platen 620 by use of negative pressure airflow generated by the suction fan 650.

Figure 9A:
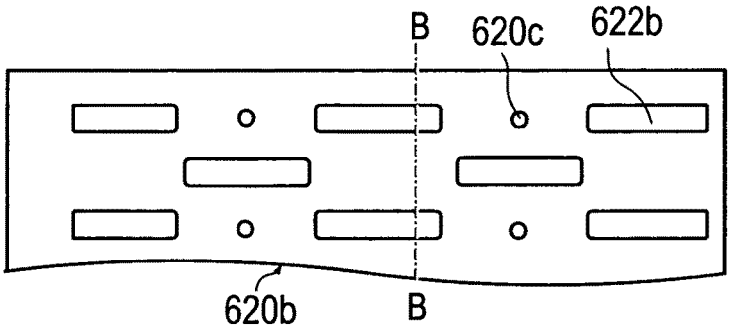
FIG. 9A is an upper surface view of a lower plate according to the present embodiment
Figure 9B:
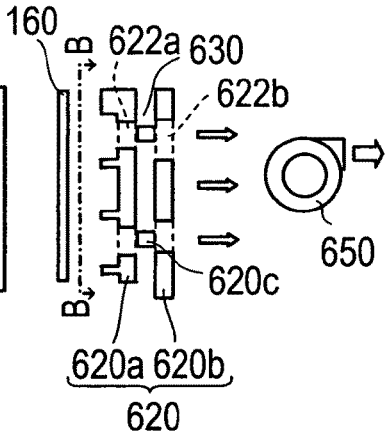
FIG. 9B is a cross-sectional view taken along the line B-B in FIG. 9A.

According to the present embodiment, the platen 620 is configured to have a two-layer structure composed of an upper plate 620*a* and a lower plate 620*b* as shown in FIG. 6. FIG. 9A is an upper surface view of the lower plate 620*b*. FIG. 9B is a cross-sectional view taken along the line B-B in FIG. 9A.

As shown in FIGS. 8A and 8B, the upper plate 620*a* has a plurality of upper suction through-holes 622*a* in an area where the plurality of the adhesion through-holes 165 of the transfer belt 160 are provided. The upper suction through-holes 622*a* in the upper plate 620*a* are widely opened toward the surface (upper side) of the upper plate 620*a*, and the plurality of the concave portions 621 are formed at set intervals and communicated with the upper suction through-holes 622*a*.

The concave portions 621 are aligned in a zigzag manner so that the respective side spaces do not overlap in a direction perpendicular to the sheet transfer direction. While the zigzag alignment is employed for the concave portions 621 in the present embodiment, areas or positions of the concave portions 621 can be varied alternately, for instance.

A surface area of each concave portion 621 (a plane area in an upper surface of the platen 620) has an area enough to cover several sequential adhesion through-holes 165 in the sheet transfer direction as shown in FIG. 8A. When the maximum number of the adhesion through-holes 165 covered by each concave portion 621 is assumed to be "N" holes, each suction through-hole 622 communicated with each concave portion 621 has an area that is more than "N" times larger than an area of the adhesion through-hole 165. Therefore, air entering the concave portions 621 from the side of the ink head 110*a* through the plurality of the adhesion through-holes 165 can be suctioned evenly. In addition, a surface area of each concave portion 621, which is an air inlet to the openings 623, is configured to be larger than a surface area of each suction through-hole 622, which is an air outlet from the openings 623. Thus, it is possible increase airflow rate from each concave portion 621.

As shown in FIGS. 9A and 9B, the lower plate 620*b* has a plurality of lower suction through-holes 622*b* in an area where the plurality of the adhesion through-holes 165 of the transfer belt 160 are provided similar to the upper suction through-holes 622*a* that the upper plate 620*a* has. In addition, spacers 620*c* are provided between the upper plate 620*a* and the lower plate 620*b*. Thus, an internal airflow space 630 is provided so as to keep a predetermined gap between the upper plate 620*a* and the lower plate 620*b*. The internal airflow space 630 enables air to flow between the suction through-holes 622. Moreover, negative pressure airflow generated by the suction fan 650 can be dispersed due to the internal airflow space 630. Accordingly, it is possible to obtain sufficient suction force, while keeping restricting pulsation of airflow caused by suctioning air.

According to the present embodiment, the net-like airflow equalizing plate 640 is provided between the platen 620 and the suction fan 650. FIG. 10A is an upper surface view of the airflow equalizing plate 640 provided under the lower plate 620*b*. FIG. 10B is a cross-sectional view taken along the line C-C in FIG. 10A. As shown in FIGS. 10A and 10B, the airflow equalizing plate 640 is a net-like plate member provided between the platen 620 and the suction fan 650 to equalize suction force generated by the suction fan 650 with respect to the adhesion through-holes 165 and the suction through-holes 622. The net-like pattern of the airflow equalizing plate 640 can be changed depending on areas or positions of the concave portions 621.

(Sheet Lift Prevention Mechanism)

According to the present embodiment, the suction through-holes 622 in the platen 620 are configured to be partially plugged depending on an arrangement of the ink heads 110*a* so as to adjust a number density of the suction through-holes 622 in the platen 620. FIGS. 11A to 13B are upper surface views and cross-sectional views of the concave portion 621, the upper suction through-hole 622*a* and a plugging plate 624 of the upper plate 620.

The opening 623 composed of the concave portion 621 and the upper suction through-hole 622*a* has a cross-sectional reverse convex shape widely opened toward the surface (upper side) of the upper plate 620*a*. The suction through-hole 622 is to be plugged by inserting the plugging plate 624 in the concave portion 621.

As shown in FIGS. 11A to 13B, the plugging plate 624 is a lid member inserted in a part of or the whole of the reverse convex portion that is a cross-sectional shape of the opening 623. The upper suction through-hole 622*a* and the lower suction through-hole 622*b* are plugged with the plugging plate 624 inserted from the upper surface in order to stop airflow passing through the upper suction through-hole 622*a* and the lower suction through-hole 622*b*. The plugging plate 624 can be made of synthetic resin such as plastic, for instance.

The plugging plate 624 may have several configurations. For instance, as shown in FIGS. 11A and 11B, the plugging plate 624 can have the completely same cross-sectional shape as the opening 623. As shown in FIGS. 12A and 12B, the plugging plate 624 can also have the shape to be partly inserted in the opening 623. In this case, a plugging member 624*a* having an upper portion thinner than the concave portion 621 can be used so that a groove 621*a* is provided at an upper portion of the concave portion 621. Furthermore, as shown in FIGS. 13A and 13B, the plugging plate 624 can be a plate member 624*b* for plugging only the suction through-hole 622*a*, remaining the whole concave portion 621. Due to the above-mentioned configurations to partly plug the suction through-hole 622 and the concave portion 621, the upper portion of the opening 623 is provided with the groove 624*a* or the concave portion 621 not being plugged with the plugging plate 624, so that airflow in the platen 620 can be controlled.

Figure 14:
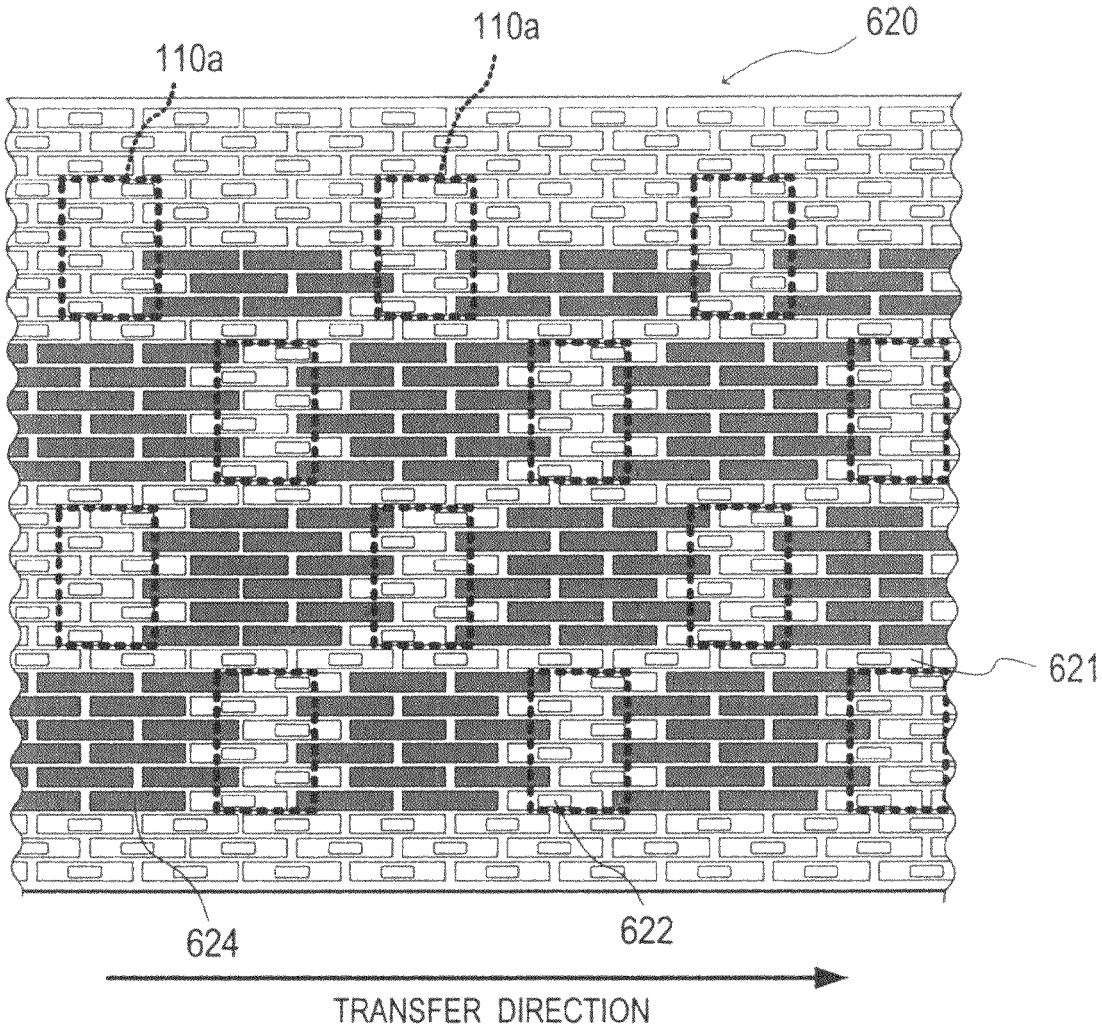
FIG. 14 is an upper surface view showing a positional relationship between ink heads and plugging plates on a platen according to the present embodiment.
Figure 15:
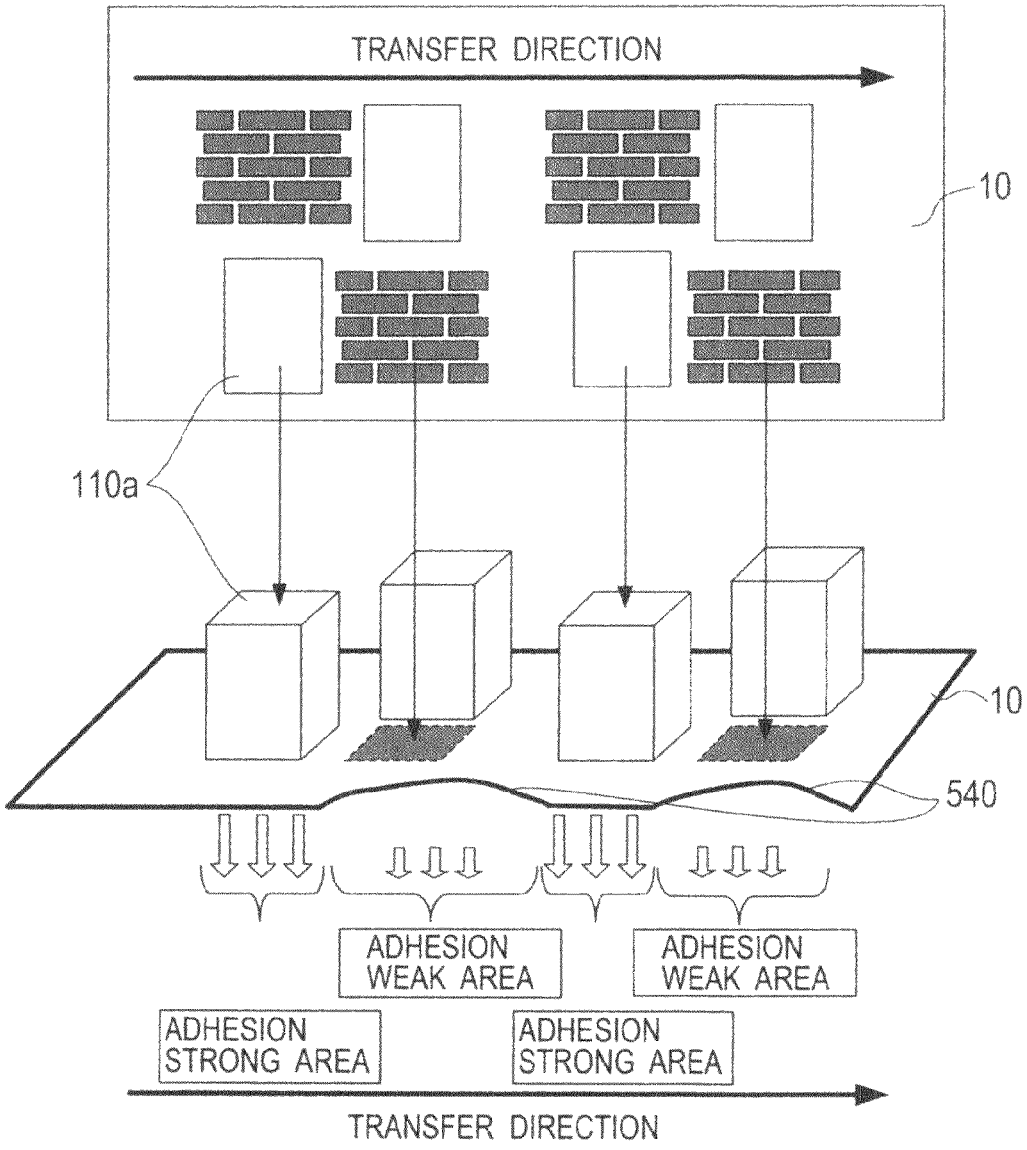
FIG. 15 is a perspective view showing lifted portions in a sheet caused by suction gaps in the present embodiment.

According to the present embodiment, the suction through-holes 622 in the platen 620 are partly plugged by inserting the plugging plates 624 in the concave portions 621 depending on the arrangement of the ink heads 110*a* in order to adjust a number density of the suction through-holes 622. FIG. 14 is an upper surface view showing a positional relationship between the ink heads 110*a* and the plugging plates 624 in the platen 620. FIG. 15 is a perspective view showing lifted portions in a sheet 10 caused by suction gaps.

As shown in FIG. 14, a number density of the suction through-holes 622 in the platen 620 is higher in image forming areas including areas under the ink heads 110*a* or certain areas located upstream in the sheet transfer direction than areas outside the image forming areas. Specifically, the suction through-holes 622 in the image forming areas under the ink heads 110*a* in the platen 620 are not plugged with the plugging plates 624. While, the suction through-holes 622 provided downstream of the image forming areas are plugged with the plugging plates 624 so as to lessen the opened suction through-holes 622. Thus, the number density of the suction through-holes 622 can be varied.

Thus, as shown in FIG. 15, adherence to the sheet 10 in the image forming areas under the ink heads 110*a* is increased since the suction through-holes 622 are provided a lot in the areas in the platen 620. While, the suction through-holes 622 provided downstream of the image forming areas are plugged with the plugging plates 624 to lessen the number of the opened suction through-holes 622. This makes adherence to the sheet 10 lower.

Figure 16:
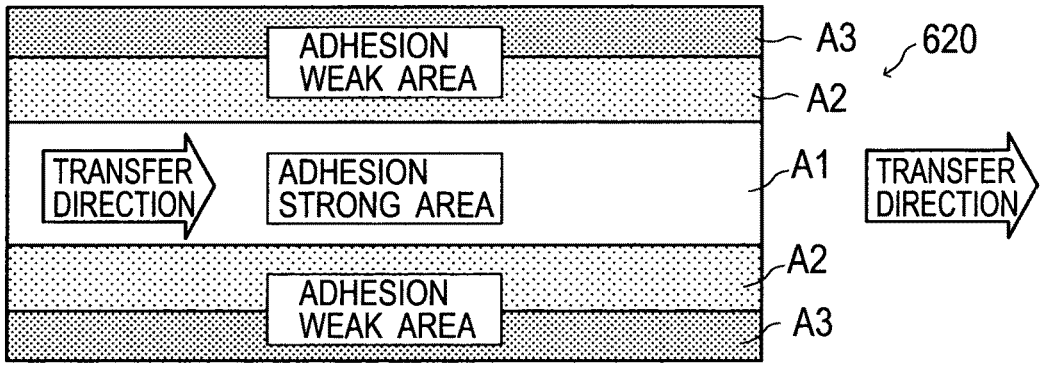
FIG. 16 is a view showing one example of a difference in distribution of suction through-holes in a platen according to the present embodiment.

With regard to a difference in distribution of the suction through-holes 622 in the platen 620, as shown in FIG. 16, the number of the suction through-holes 622 can be adjusted to gradually decrease from a middle area A1 in the image forming areas including the ink heads 110*a* toward areas A3 in side edges of the platen 620 via areas A2 adjacent to the middle area A1 in the main scanning direction perpendicular to the sheet transfer direction.

Specifically, the number of the suction through-holes 622 that are plugged with the plugging plates 624 is small in the middle area A1 in the image forming areas. While, the number of the suction through-holes 622 plugged with the plugging plates 624 gradually increases from the middle area A1 toward the areas A2 and A3 in the side edges of the platen 620. Therefore, during printing, adherence in the middle area A1 in the image forming areas is increased due to a lot of the suction through-holes 622, and adherence in the side edges of the platen 620 is decreased since the suction holes 622 are fewer.

(Operation/Effect)

According to the above-mentioned embodiment, it is possible to eliminate ink mist caused by propelling ink from the ink heads 110*a* downwardly through the adhesion through-holes 165 in the transfer belt 160, the suction through-holes 622 in the platen 620 and the airflow equalizing plate 640.

In particular, airflow generated by the suction fan 650 is absorbed once in the concave portions 621 in the platen 620. Therefore, the pulsation of suction airflow is controlled so as to achieve a stable suction effect. In addition, the respective concave portions 621 are separately formed between the adjacent concave portions 621 and aligned in a zigzag manner. Thus, an absorptive effect of airflow can be obtained in the concave portions 621.

In other words, the number or total area of the adhesion through-holes 165 included in each concave portion 621 increases and decreases according to an actuation of the transfer belt 160. Therefore, it is possible to vary suction force in each concave portion 621 depending on the number or total area of the adhesion through-holes 165, and possible to disperse suction airflow. This prevents airflow at the ink heads 110*a*, where ink mist is caused, from being maximized locally. Thus, pulsation of airflow can be controlled.

Figure 17A:
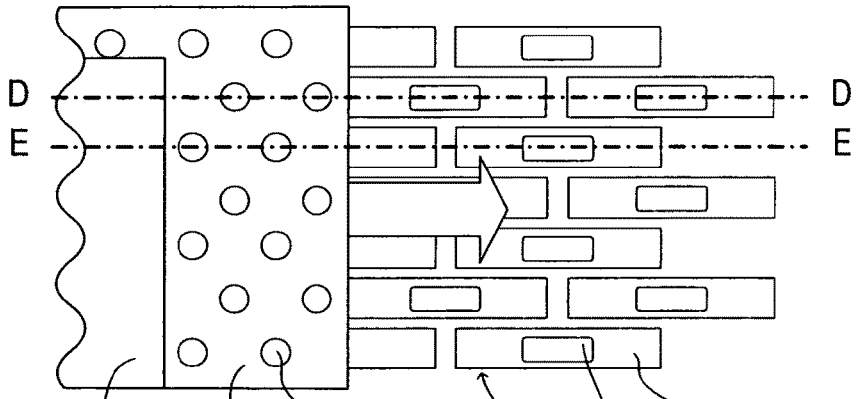
FIG. 17A is a view showing a shift in suction force due to a sheet movement on a transfer belt according to the present embodiment
Figure 17B:
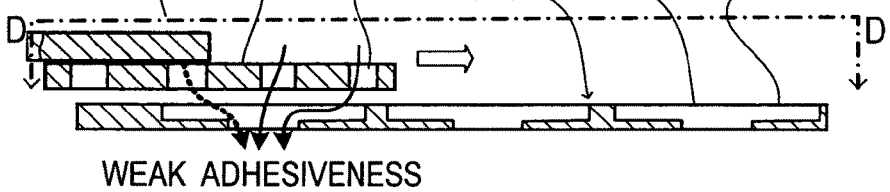
FIG. 17B is a cross-sectional view taken along the line D-D in FIG. 17A.
Figure 17C:
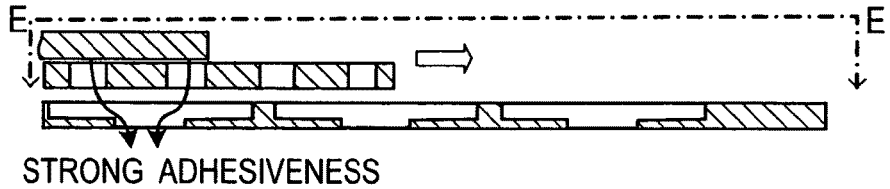
FIG. 17C is a cross-sectional view taken along the line E-E in FIG. 17A.
Figure 19A:
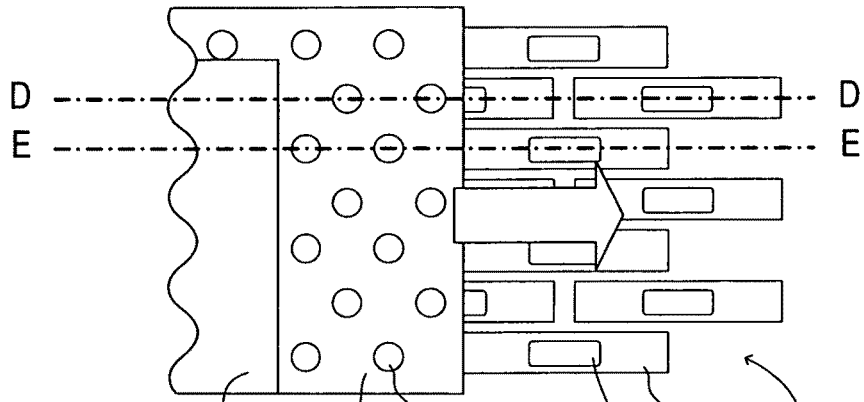
FIG. 19A is a view showing a shift in suction force due to a sheet movement on a transfer belt according to the present embodiment
Figure 19B:
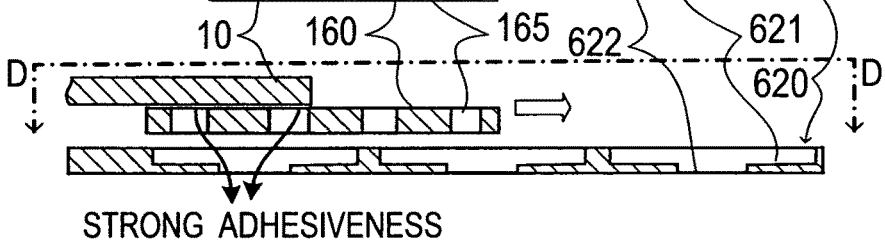
FIG. 19B is a cross-sectional view taken along the line D-D in FIG. 19A.
Figure 19C:
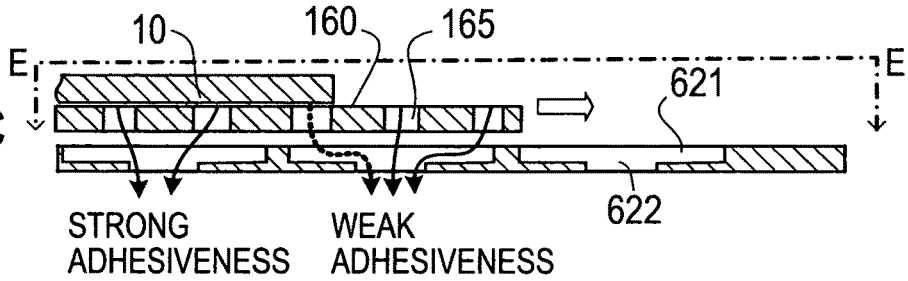
FIG. 19C is a cross-sectional view taken along the line E-E in FIG. 19A.

FIGS. 17A, 18A and 19A are views showing a shift in suction force due to a movement of a sheet 10 on the platen 160. FIGS. 17B, 18B and 19B are cross-sectional views taken along the lines D-D in FIGS. 17A, 18A and 19A. FIGS. 17C, 18C and 19C are cross-sectional views taken along the lines E-E in FIGS. 17A, 18A and 19A.

As shown in FIGS. 17A to 19C, the transfer belt 160 moves in the sheet transfer direction sliding on an upper surface of the platen 620. The adhesion through-holes 165 formed in the transfer belt 160 and the sheet 10 placed on the transfer belt 160 also move in the sheet transfer direction according to the movement of the transfer belt 160. Since the sheet 10 adheres to the transfer belt 160, the adhesion through-holes 165 and the sheet 10 integrally move on the platen 620 without change of the relative positional relationship between the adhesion through-holes 165 in the transfer belt 160 and the sheet 10. While, the transfer belt 160 slides on the platen 620, which is fixed. Thus, the relative positional relationship of the adhesion through-holes 165 and the sheet 10 to the concave portions 621 and the suction through-holes 622 in the upper plate 620*a* of the platen 620 varies every moment according to the movement of the transfer belt 160. FIGS. 17A to 19C show the relative positional relationships of the adhesion through-holes 165 and the sheet 10 to the concave portions 621 and the suction through-holes 622 in chronological order.

FIGS. 17A to 17C show a situation that a front edge part of the sheet 10 reaches an upstream edge part of the concave portion 621. In the cross-sectional view taken along the line D-D as shown in FIG. 17B, three adhesion through-holes 165 are located within an area of the concave portion 621, and one of them is blocked by the sheet 10. In this case, suction airflow becomes slow, and negative pressure (adhesive effect) acting on the adhesion through-hole 165 under the sheet 10 is weakened since there are two adhesion through-holes 165 not blocked by the sheet 10. On the other hand, as shown in the cross-sectional view taken along the line E-E in FIG. 17C adjacent to the line D-D, maximum negative pressure is applied to the sheet 10 since all the adhesion through-holes 165 on the transfer belt 160 are blocked.

Next, as shown in FIG. 18B, three adhesion through-holes 165 are located within the area of the concave portion 621, and two of them are blocked by the sheet 10 in the cross-sectional view taken along the line D-D due to the movement of the transfer belt 160. In this case, there is one adhesion through-hole 165 not blocked by the sheet 10 in the line D-D. Since airflow rate is inversely proportional to a cross-sectional area of a flow path, airflow rate v becomes faster than the case of FIG. 17B due to an area decrease of the adhesion through-holes 165. In addition, since negative pressure of this airflow is proportional to the square of the airflow rate v, the area of the suction through-holes 165 decreases and the airflow rate v becomes faster when the adhesion through-hole 165 not blocked by the sheet 10 is transferred outside of the area of the concave portion 621. Accordingly, negative pressure acting on the sheet 10 gradually increases. While, as shown in the cross-sectional view taken along the line E-E in FIG. 18C, maximum negative pressure is applied to the sheet 10 since all the adhesion through-holes 165 on the transfer belt 160 are blocked.

Next, as shown in FIG. 19B, two adhesion through-holes 165 are located within the area of the concave portion 621, and all of them are blocked by the sheet 10. Therefore, maximum negative pressure is applied to the sheet 10. While, as shown in the cross-sectional view taken along the line E-E in FIG. 19C, the sheet 10 reaches an upstream edge part of the next concave portion 621. In this case, three adhesion through-holes 165 are located within the area of the concave portion 621, and one of them is blocked by the sheet 10. Thus, suction airflow becomes slow, and negative pressure acting on the adhesion through-hole 165 under the sheet 10 is weakened.

Due to the zigzag alignment of the concave portions 621 in the platen 620 according to the present embodiment, the number or total area of the adhesion through-holes 165 included in each concave portion 621 increases and decreases according to the movement of the transfer belt 160. Therefore, it is possible to vary suction force in each concave portion 621 depending on the number or total area of the adhesion through-holes 165. As a result, suction force acting on the respective concave portions 621 is alternately changed between the adjacent concave portions 621. Thus, it is possible to prevent airflow from being maximized locally by dispersing suction airflow, and control pulsation of airflow.

In addition, as shown in FIG. 6, for instance, the platen 620 according to the present embodiment is provided with the internal airflow space 630 between the upper plate 620*a* and the lower plate 620*b*. The internal airflow space 630 enables air to flow between the suction through-holes 622. Therefore, it is possible to disperse suction airflow and prevent airflow at the ink heads 110*a*, where ink mist is caused, from being maximized locally. As a result, pulsation of airflow can be controlled, and blot due to ink mist can be decreased.

Moreover, the airflow equalizing plate 640 is provided under the platen 620. Thus, it is possible to avoid variation in suction airflow and indirectly prevent airflow at the ink heads 110*a* from being maximized locally by evenly applying suction force to the platen 620.

According to the present embodiment, the concave portions 621 are plugged with the plugging plates 624 depending on the arrangement of the ink heads 110*a* so as to adjust the number density of the suction through-holes 622 in the platen 620. Therefore, suction force from the suction through-holes 622 acting on the sheet 10 can be varied depending on spots. Thus, it is possible to prevent the sheet 10 from cockling and being partially lifted upwardly, and maintain flatness of the sheet 10 under the ink heads 110*a* since swelling portions on the sheet 10 can be tightly attached to appropriate locations.

In particular, suction force acting on the sheet 10 can be enhanced in the image forming areas under the ink heads 110*a* due to the plurality of the suction through-holes 622 so as to maintain flatness of the sheet 10 by increasing the number density of the suction through-holes 622 in the image forming areas in the platen 620 including the ink heads 110*a* more than the number density of the suction through-holes 622 in areas outside the image forming areas.

According to the present embodiment, the distribution of the suction through-holes 622 in the platen 620 is adjusted to gradually decrease from the middle area A1 in the image forming areas toward the areas A3 in the side edges of the platen 620 in the main scanning direction perpendicular to the sheet transfer direction. Therefore, the sheet 10 can be held tightly in the middle area A1 in the image forming areas due to the plurality of the suction through-holes 622. In addition, the number of the suction through-holes 622 in the areas A2 and A3 is small. Thus, it is possible to release swelling due to cockling on the sheet 10 outward by decreasing suction force in order to form images without wrinkles.

According to the present embodiment as described above, the number density of the suction through-holes 622 in the platen 620 is adjusted by plugging the suction through-holes 622 with the plugging plates 624. Therefore, it is possible to manufacture the platen 620 by a consistent manufacturing step independent of a positional relationship of the ink heads 110*a*, and reduce production costs since the number density of the suction through-holes 622 in the platen 620 can be adjusted by simply plugging the suction through-holes 622 with the plugging plates 624.

In addition, the plugging plates 624 have the same configuration as the concave portions 621 formed to be widely opened toward the surface (upper side) of the platen 620 and communicated with the suction through-holes 622. Therefore, it is possible to adjust the number density of the suction through-holes 622 in the platen 620 easily by plugging the concave portions 621 with the plugging plates 624.

According to the present embodiment, a depth of the concave portions 621 is adjusted depending on a thickness of the plugging plates 624. Thus, the suction through-holes 622 can be plugged without plugging the concave portions 621 by employing the plugging plates 624 of which the upper portions are thinner than the depth of the concave portions 621. Accordingly, airflow in the platen 620 can be adjusted by use of the remaining spaces in the concave portions 621, and blot due to ink mist can be decreased.

Moreover, air at the side of the ink heads 110*a* flows into the suction through-holes 622 via the concave portions 621 due to negative pressure airflow generated by the suction fan 650. Therefore, airflow is absorbed once in the side spaces provided in the concave portions 621 in the platen 620, and pulsation of suction airflow is controlled so as to achieve a stable suction effect. Thus, it is possible to prevent ink mist from being concentrated locally by controlling pulsation of airflow, and decrease ink mist collected around the ink heads 110*a*.

Furthermore, the widely opened concave portions 621 are provided at the upper portions of the suction through-holes 622 of the platen 620 so that the suction through-holes 622 can keep overlapping with the openings of the adhesion through-holes 165 in the transfer belt 160 for a certain length of time. Thus, an efficient suction result can be achieved. Moreover, it is possible to lower ink mist, power consumption, and a noise by the suction fan 650 since an adequate and stable suction effect can be obtained due to efficient suctioning even if airflow generated by the suction fan 650 is lessened.

According to the present embodiment, each concave portion 621 has a plane area capable of covering the sequential several adhesion through-holes 165 in the sheet transfer direction. Thus, it is possible to prevent airflow at the ink heads 110*a* from being maximized locally, control pulsation of airflow, and decrease blot due to ink mist by evenly suctioning air entering the concave portions 621 from the side of the ink heads 110*a* through the plurality of the adhesion through-holes 165. In addition, the number or total area of the adhesion through-holes 165 covered by each concave portion 621 increases and decreases according to the movement of the transfer belt 160. Therefore, it is possible to vary suction force acting on the sheet 10 depending on the number or total area of the adhesion through-holes 165.

As a result of the present embodiment, it is possible to prevent a sheet from cockling and being partially lifted upwardly by use of a simple configuration, and hold swelling portions of the sheet by being tightly attached to appropriate locations so as to easily maintain flatness of the sheet under ink heads, by controlling suction force depending on shapes of suction openings. Moreover, blot due to ink mist can be decreased and a stable sheet adhesion can be obtained by controlling pulsation of suction airflow. Furthermore, an efficient suction result can be achieved by dispersing suction force. Therefore, it is possible to obtain an adequate suction effect and lower ink mist, power consumption and a noise even if airflow by the suction fan is lessened relatively.

While one embodiment of the present invention has been described using specified terms, such description is for illustrative purposes, and it is to be understood that changes and variations may be made without departing from the spirit or scope of the following claims.

This application is based upon the Japanese Patent Applications No. 2008-259074 and No. 2008-259087, filed on Oct. 3, 2008, and the entire content of which is incorporated by reference herein.

What is claimed is:

1. A sheet transfer mechanism of a printer to form an image on a sheet being transferred in a transfer route by propelling ink at an image former, comprising:

a transfer belt that has a plurality of adhesion through-holes for holding a sheet and transfers the sheet being held thereon;

a platen that slidably supports the transfer belt in an area facing the image former and has a plurality of suction through-holes uniformly arranged all over the platen in an area through which the plurality of the adhesion through-holes pass;

an aspirator that generates airflow with negative pressure for holding the sheet on the transfer belt through the plurality of the suction through-holes and the plurality of the adhesion through-holes; and an adjuster that adjusts a number density of suction through-holes in the platen depending on an arrangement of the image former;

wherein the platen has a plurality of concave portions communicated with the plurality of the suction through-holes and opened toward an upper surface of the platen; and wherein the number density of open suction through-holes in an image forming area of the platen including an area under the image former is more than the number density of open suction through-holes in an area outside the image forming area.

2. The sheet transfer mechanism of a printer according to claim 1, wherein the number density of open suction through-holes gradually decreases from a middle area of the image forming area toward side edge areas of the platen in a direction perpendicular to the sheet transfer direction.

3. The sheet transfer mechanism of a printer according to claim 1, wherein the adjuster adjusts the number density of open suction through-holes by plugging some of the suction through-holes.

4. The sheet transfer mechanism of a printer according to claim 1, wherein the platen has a plurality of concave portions communicated with the plurality of the suction through-holes and opened toward an upper surface of the platen, the adjuster is a plurality of plugging plates capable of engaging with the plurality of the concave portions, and the number density of open suction through-holes is adjusted by the plugging plates engaging with some of the concave portions so as to plug some of the suction through-holes.

5. The sheet transfer mechanism for a printer according to claim 4, wherein each concave portion has a depth adjusted depending on a thickness of each plugging plate.

6. The sheet transfer mechanism of a printer according to claim 1, wherein the plurality of concave portions are aligned so as not to overlap each other in a direction perpendicular to the sheet transfer direction.

7. The sheet transfer mechanism of a printer according to claim 1, wherein each concave portion has a plane area capable of covering some of the adhesion through-holes sequentially in the sheet transfer direction.

8. The sheet transfer mechanism of a printer according to claim 7, wherein each suction through-hole has an area larger than a total area of a maximum number of the adhesion through-holes that each concave portion can cover.

9. The sheet transfer mechanism of a printer according to claim 1, wherein the platen is configured to have a two-layer structure composed of an upper plate and a lower plate, spacers are provided between the upper plate and the lower plate so as to keep a predetermined gap and form an internal airflow space therebetween, the plurality of the suction through-holes includes a plurality of upper suction through-holes in the upper plate and a plurality of lower suction through-holes in the lower plate, and the respective upper suction through-holes and lower suction through-holes are communicated with the internal airflow space, and the upper plate is communicated with the plurality of the upper suction through-holes, and has a plurality of concave portions opened toward an upper surface of the upper plate.

10. The sheet transfer mechanism of a printer according to claim 1, further comprising:

an airflow equalizing plate having a net pattern that is provided between the platen and the aspirator.

* * * * *